US005238508A

United States Patent [19]

Yoshitake et al.

[11] Patent Number: 5,238,508

[45] Date of Patent: Aug. 24, 1993

[54] FERRITIC-AUSTENITIC DUPLEX STAINLESS STEEL

[75] Inventors: Akira Yoshitake; Akio Kuhara; Toshiaki Ishii, all of Osaka, Japan

[73] Assignee: Kubota, Ltd., Osaka, Japan

[21] Appl. No.: 622,401

[22] Filed: Dec. 3, 1990

Related U.S. Application Data

[63] Continuation of Ser. No. 902,054, Aug. 26, 1986, abandoned, which is a continuation of Ser. No. 696,294, Jan. 29, 1985, abandoned.

[30] Foreign Application Priority Data

Jul. 2, 1984 [JP] Japan ..... 59-21388
Jul. 2, 1984 [JP] Japan ..... 59-21389

[51] Int. Cl.[5] ..... C22C 38/42

[52] U.S. Cl. ..... 148/325; 148/327; 148/909

[58] Field of Search ..... 138/177, DIG. 6

[56] References Cited

U.S. PATENT DOCUMENTS

| | | | |
|---|---|---|---|
| 4,032,367 | 6/1977 | Richardson et al. | 148/325 |
| 4,390,367 | 6/1983 | Niehaus et al. | 148/325 |
| 4,391,635 | 7/1983 | Murakami et al. | 148/37 |
| 4,561,890 | 12/1985 | Hiraishi et al. | 148/325 |

FOREIGN PATENT DOCUMENTS

| | | | |
|---|---|---|---|
| 55-158256 | 12/1980 | Japan | 148/37 |
| 58-52464 | 3/1983 | Japan | 148/325 |
| 58-144460 | 8/1983 | Japan . | |

*Primary Examiner*—Deborah Yee
*Attorney, Agent, or Firm*—Armstrong, Westerman, Hattori, McLeland & Naughton

[57] ABSTRACT

Ferritic-austenitic duplex stainless steel comprising the following components in the following proportions in % by weight:

$0<C\leqq 0.08$,

| | |
|---|---|
| Si | 0.2–2.0, |
| Mn | 0.2–2.0, |
| Cr | 19.0–30.0, |
| Ni | 3.0–9.0, |
| Mo | 1.0–5.0, |
| Cu | 0.5–3.0, |
| Co | 0.2–4.0, |
| N | 0.05–0.35, |

the balance being substantially Fe and inevitable impurities, the proportions of Cr and Ni having the correlation of $19.0\leqq Cr<24.0$ and $3.0\leqq Ni\leqq 8.0$, or $24.0\leqq Cr\leqq 30.0$ and $4.0\leqq Ni\leqq 9.0$ the micro structure of the steel containing delta-ferrite phase in an amount of 30 to 70% in area ratio.

2 Claims, 3 Drawing Sheets

FERRITIC-AUSTENITIC DUPLEX STAINLESS STEEL

This application is a continuation of U.S. application Ser. No. 06/902,054 filed Aug. 26, 1986 which is a continuation of U.S. application Ser. No. 06/696,294 filed Jan. 29, 1985, both applications now abandoned.

TECHNICAL FIELD

The present invention relates to ferritic-austenitic duplex stainless steel, and more particularly to duplex stainless steel which has excellent resistance to stress corrosion cracking, pitting, crevice and like corrosion in an environment containing a chloride, carbon dioxide gas or sour gas and which is improved in mechanical properties such as strength and toughness, the steel especially having outstanding corrosion resistance, high proof stress.

PRIOR ART

Corrosion resistant materials heretofore used include austenitic stainless steels such as SUS 304 stainless steel (8–11% Ni, 18–20% Cr) according to JIS (Japanese Industrial Standard), etc. and stainless steels having a duplex structure of ferrite and austenite, such as SUS 329J1 (3–6% Ni, 23–28% Cr, 1–3% Mo), SCS 13A (8–11% Ni, 18–21% Cr), SCS 14A (9–12% Ni, 18–21% Cr, 2–3% Mo), CD-4MCu prescribed by SFSA (Steel Founder's Society of America), etc.

Austenitic stainless steel, such as SUS 304 stainless steel, exhibits high corrosion resistance due to Cr and Ni which are the main components but have the serious drawback of being prone to stress corrosion cracking in environments containing chlorine ion ($Cl^-$). These steels also have very low resistance to local corrosion such as pitting or crevice corrosion.

On the other hand, those steels having a duplex structure of ferrite and austenite generally have high corrosion resistance, suitable strength and toughness due to the combined characteristics of the two phases, and relatively satisfactory weldability. Accordingly they have found wide use as materials for chemical industrial plants and seawater apparatus in recent years.

To obtain energy in recent years, oil and natural gas wells, for example, are drilled inevitably under ever aggravated circumstances. As the depth of the well increases, the piping or tubing for the well is more likely to be exposed to corrosive factors such as chlorine ion, carbon dioxide, hydrogen sulfide gas and the like and also to elevated temperature and pressure (e.g. 300° C., 6000 psi). Further it is practice to forcibly introduce carbon dioxide, seawater or the like into the well for the recovery of the well. Thus, the piping and tubing are used in an environment of greatly enhanced severity. When conventional materials are used for the piping of oil or natural gas wells, the material sometimes fails to withstand the environment and suffers from corroded damage owing to insufficient resistivity to pitting and crevice corrosion or stress corrosion cracking. Furthermore, the material, which is exposed to an elevated temperature and high pressure, is likely to become seriously impaired in toughness to break early.

It is thus desired to provide a material suited as piping and tubing members for oil or natural gas wells, which is excellent in corrosion properties, and high in strength specifically such as proof stress. The material is also required to be small in reduction of toughness due to the heat by welding or to overcome the increase of elevated temperature and high pressure environment.

SUMMARY OF THE INVENTION

An object of the present invention, which has been accomplished in view of the foregoing problems, is to provide ferritic-austenitic duplex stainless steel which exhibits high corrosion resistivity in corrosion environments at an elevated temperature and high pressure (e.g. 300° C., 6000 psi), especially in an environment containing a chloride, carbon dioxide or hydrogen sulfide gas and which also has high strength and high toughness.

Another object of the invention is to provide a duplex stainless steel which is suitable as a material for tubing or couplings for oil and gas wells, and gathering pipe, line pipe or other piping and tubing members.

The present invention provides ferritic-austentic duplex stainless steel which comprises up to 0.08% (by weight, the same as hereinafter unless otherwise specified). C, 0.2–2.0% Si, 0.2–2.0% Mn, 19.0–30.0% Cr, 3.0–9.0% Ni, 1.0–5.0% Mo, 0.5–3.0% Cu, 0.2–4.0% Co, 0.05–0.35% N, the balance being substantially Fe and inevitable impurities, the proportions of Cr and Ni being in the correlation of $19.0\% \leqq Cr < 24.0$ and $3.0\% \leqq Ni \leqq 8.0\%$, or $24.0\% \leqq Cr \leqq 30.0$ and $4.0\% \leqq Ni \leqq 9.0\%$, the micro structure of the steel containing delta-ferrite phase in an amount of 30 to 70% in area ratio.

DETAILED DESCRIPTION OF THE INVENTION

Figure 1:
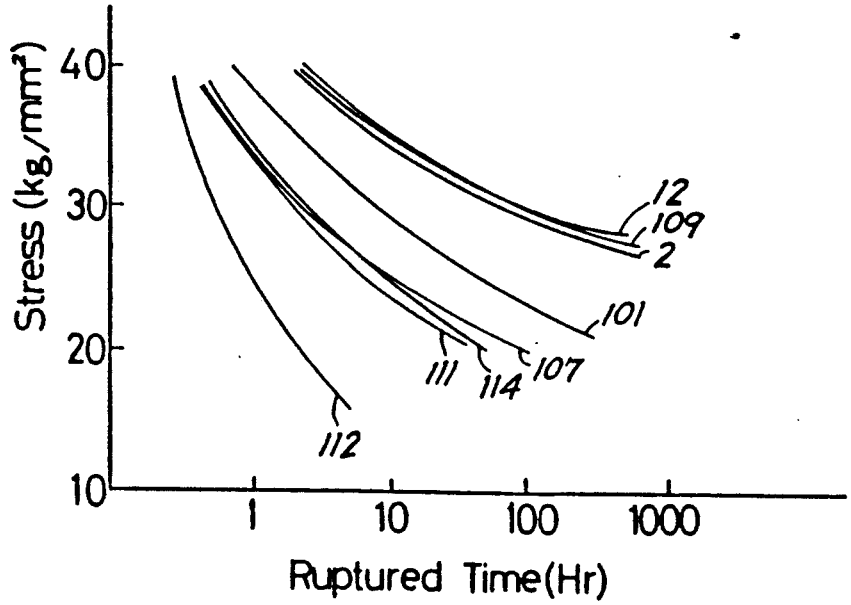
FIG. 1 and FIG. 2 are graphs showing stress corrosion cracking resistance characteristics.

The proportions of the components of the steel according to the invention are limited to the ranges given below for the following reasons.

$0 < C \leqq 0.08\%$

C forms austenite and is very effective for giving improved strength. However, if the C content is excessive, chromium carbide is liable to separate out to reduce the Cr concentration in the vicinity of the carbide, consequently giving the steel reduced resistance to local corrosion such as pitting, crevice corrosion or intergranular corrosion and rendering the steel prone to stress corrosion cracking. Accordingly the upper limit is 0.08%.

Si: 0.2–2.0%

At least 0.2% of Si needs to be present to oxidize the steel in molten state and assure good castability. However, an excess of Si results in lower toughness and impaired weldability, so that the upper limit is 2.0%.

Mn: 0.2–2.0%

About 0.2% of Mn is incorporated into the steel composition in the usual process of deoxidation and desulfurization. Mn is effective for stabilizing the austenitic phase of the steel base. Mn fully serves these purposes when contained in an amount of up to 2%. The Mn content, which need not exceed this amount, is therefore 0.2 to 2.0%.

Cr: 24.0–30.0% with 4.0–9.0% of Ni, or

Cr: at least 19.0% but less than 24.0% with 3.0–8.0% Ni

Cr is highly effective for giving improved resistance to corrosion, especially to intergranular corrosion and also contributes to the improvement of resistance to stress corrosion cracking. Cr, which is an element for forming ferrite, affords enhanced strength by forming the ferrite phase of the present duplex structure. On the other hand, an excess of Cr lowers the toughness of steel and produces brittle sigma phase during casting.

Ni stabilizes the austenitic phase, improves the toughness of steel and is also essential from the viewpoint of corrosion resistance. However, a larger amount of Ni, even if present, does not produce a correspondingly increased effect in improving corrosion resistance and mechanical properties, is economically disadvantageous and further produces an excess of austenitic phase in the duplex structure to upset the quantitative balance between the two phases.

As will be described later, the duplex stainless steel of the present invention is properly adjusted in the quantitative balance between the two phases, i.e. ferrite and austenite and is thereby given such mechanical properties that strength is in accord with toughness. For this purpose, the amount of delta ferrite is 30 to 70% in area ratio according to the invention.

Since Cr and Ni have a correlation therebetween in determining the quantitative balance between the ferrite and austenite two phases, the Cr and Ni contents must be determined with consideration given not only to the individual effects mentioned but also to the assurance of the amount of delta ferrite in the specified range. According to the invention, therefore, the Cr content should be 24.0 to 30.0% with 4.0 to 9.0% of Ni, or at least 19.0% but less than 24.0% with 3.0 to 8.0% of Ni.

Mo: 1.0–5.0%

Mo is highly effective for giving improved corrosion resistance to the stainless steel. It is very effective for improving resistance especially to pitting and crevice corrosion. Use of at least 1.0% of Mo is remarkably effective for improving resistance to corrosion due to non-oxidizing acids and also resistance to pitting, intergranular corrosion and stress corrosion cracking in chloride-containing solutions. However, if Mo is used in larger amounts, the corrosion resistance improving effect levels off, while the steel, when cast, becomes more brittle owing to precipitation of sigma phase. The upper limit is therefore 5.0%.

Cu: 0.5–3.0%

Cu gives enhanced resistance to corrosion, especially to stress corrosion cracking, in environments having a low chlorine ion concentration and reinforces the austenitic solid solution. To assure these effects fully, at least 0.5% of Cu needs to be present, whereas the upper limit should be 3.0% because an excess of Cu entails impaired toughness due to the formation of intermetallic compounds.

Co: 0.2–4.0%

Co is most characteristic of the steel of the present invention. Like Ni, Co is an element for forming substituted austenite. Whereas addition of Ni tends to reduce 0.2% proof stress, we have found that addition of Co conversely achieves an improvement in 0.2% proof stress. While it has been strongly required to provide duplex stainless steel having high mechanical strength and corrosion resistance to withstand severe corrosive environments as already stated, addition of Co to conventional stainless steel of Fe—Cr—Ni base assures satisfactory mechanical properties fulfilling the requirement.

We have further found that the addition of Co to a duplex stainless steel produces remarkably improved corrosion resistance against chlorine ion-containing environments, for example, against seawater. Further, Co in the form of a solid solution in the base acts to inhibit cohesion of precipitation products, consequently contributing a great deal to the reduction of the brittleness of sigma phase, especially brittleness due to these precipitation products at the heat-affected zone of weld joints.

To produce these effects, the Co content must be at least 0.2%. While these effects increase with an increase in the content, sufficient improvements can be achieved in mechanical properties, corrosion resistance, microstructure, etc. by the addition of up to 4.0% of Co, so that there is no need to use a larger amount. Since Co is expensive, use of larger amounts is economically disadvantageous. The Co content should therefore be 0.2–4.0%.

N: 0.05–0.35%

N, which is usually regarded as an objectionable impurity element is used in an amount of above range to give improved strength and enhanced corrosion resistance according to the invention.

N, like C, is a useful austenite forming element and forms a solid solution as interstitial element, thus giving a great strain to the crystal lattice of the steel matrix and remarkably contributing to the improvement of strength.

In the two-phase structure, N influences the proportions of the main elements, such as Cr, Ni and Mo, to be distributed to the ferrite phase as well as to the austenitic phase. Especially N serves to distribute the corrosion resistance imparting elements, such as Cr and Mo, to the austenitic phase at high concentrations to give increased corrosion resistance to the duplex stainless steel. Generally in duplex stainless steels, Cr, Mo, Si and like ferrite forming elements are distributed to the ferrite phase, and C, Mn, Ni and like austenite forming elements to the austenite phase, each in a high concentration, whereas Cr, Mo and like ferrite forming elements which contribute to corrosion resistance are distributed to the austenitic phase at high concentrations owing to the presence of N, thereby affording the duplex stainless steel increased resistance to corrosion, especially to local corrosion such as crevice corrosion or pitting.

With the present steel and like alloys which have high Cr and Mo contents and in which the proportions of distribution of each of Cr and Mo to the ferric phase and austenite phase differ greatly (in other words in alloys with marked segregation), the addition of N serves to distribute these corrosion resistant elements to the austenite phase at higher concentrations to result in remarkably improved resistance to corrosion, especially to local corrosion.

To fully assure the above effect, at least 0.05% of N needs to be present. This effect increases with an increase in the amount of N, but nitrides separate out when the N content exceeds 0.35%. It is in the form of a solid solution that N achieves remarkable improvements in strength and corrosion resistance, whereas precipitation of nitrides conversely leads to impaired corrosion resistance. Accordingly, the N content should be 0.05 to 0.35%.

The steel of the present invention contains the foregoing elements, the balance being substantially Fe except impurity elements which become incorporated inevitably.

Figure 4:
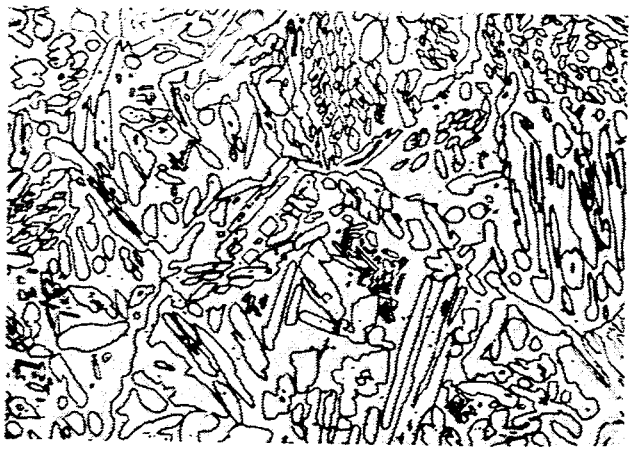
FIG. 4 and FIG. 5 are photomicrographs each showing the micro structure of a steel specimen of the invention containing about 50% of delta ferrite in area ratio.
Figure 5:
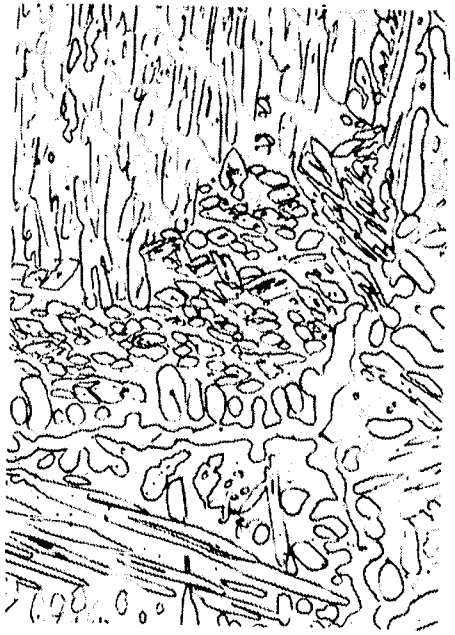

The structure of the present invention will be described next. The steel is characterized by a ferrite-austenite duplex structure which contains delta ferrite in an amount of 30 to 70% in area ratio. FIGS. 4 and 5 show the structures of specimens of the present steel which contain about 50% of delta ferrite. With the two phases in quantitative balance, the steel has such mechanical properties that the strength and toughness are in accord with each other. When the ferrite content is less than 30%, insufficient strength will result, whereas if it is more than 70%, greatly reduced ductility and toughness will result.

The amount of ferrite in the two-phase structure also has close relation to corrosion resistance. When the amount of ferrite is not smaller than 30%, the steel exhibits remarkably improved resistance to corrosion, especially to stress corrosion cracking in the presence of chlorine ion. Conversely, if the amount of ferrite exceeds 70% when the steel is used in the presence of hydrogen sulfide ($H_2S$), the ferrite phase becomes more sensitive to stress corrosion cracking due to the sulfide, and the ferrite phase selectively becomes more susceptible to pitting or crevice corrosion. Thus, the amount of ferrite is limited to the range of 30 to 70% in area ratio also from the viewpoint of corrosion resistance. The quantitative balance between the two phases can be realized by adjusting the composition within the foregoing ranges of contents of the alloy components.

The steel of the present invention is subjected to a solution heat treatment in the usual manner after casting. For the heat treatment, the steel is held heated, for example, at a temperature of 1000° to 1200° C. and then quenched (for example with water).

EXAMPLES

Steel specimens having the compositions and ferrite contents listed in Table 1 were checked for mechanical properties and subjected to welding test and corrosion resistance tests.

The balance of each composition listed in Table 1 is Fe except inevitable impurities.

Specimens 1–16 are examples of the invention, while specimens 101–114 are comparative examples. Of these comparative specimens, specimen 111 is SUS 329Jl, specimen 112 is SUS 316, specimen 113 is SCS 14A, and specimen 114 is SFSA CD-4MCu.

Specimens 1–16, 101–110 and 113–114 were pipes (135 mm in outside diameter and 600 mm in length) prepared by centrifugal casting with metal mold, while specimens 111 and 112 were commercial products. For heat treatment, all the specimens were held at 1100° C. for 1 hour per 25-mm wall thickness and then quenched with water.

(A) Mechanical property (1) Table 2 shows the results obtained by checking the specimens for 0.2% proof stress, tensile strength at room temperature, hardness and absorbed energy as determined by Charpy impact test.

In mechanical properties, especially in 0.2% proof stress, specimens 1–16 according to the invention are superior to comparative specimens 101 and 102 which are within the scope of the invention in respect of the components other than N, and the amount of ferrite. The improvement in 0.2% proof stress indicates the remarkable effect of N added to the duplex stainless steel.

Specimens 107–110 contain ferrite in amounts outside the range (30–70%) defined by the invention. Specimens 107 and 108 containing insufficient amounts of ferrite are lower than the specimens of the invention in 0.2% proof stress, whereas specimens 109 and 110 exceeding in ferrite content are inferior to those of the invention in absorbed energy of impact. This indicates that the amount of ferrite is a factor greatly influencing the mechanical properties of the duplex stainless steel, should be at least 30% from the viewpoint of strength and should not exceed 70% in view of toughness. Further when an excess of ferrite is present, the steel becomes markedly impaired in toughness upon aging as will be described later. This also indicates that the upper limit for the amount of ferrite should be 70% according to the invention.

Comparison between specimens 2, 11 and 12, or between 5, 13 and 14 according to the invention reveals that when the N content is definite at about 0.18%, with the amount of ferrite kept definite at about 50%, the 0.2% stress value increases remarkably with an increase in Co content at a rate of about 2 kg/mm$^2$ per percent of Co, 0.2% stress thus being proportional to the Co content. The tensile strength also increases. Moreover, the decrease of ductility and toughness is small despite the great improvement in strength. It is one of the outstanding effects of Co added to the duplex stainless steel that the strength can be enhanced without greatly impairing ductility or toughness.

Further as compared with conventional materials, i.e. SUS 316 (specimen 112), SCS 14A (specimen 113) and CD-4MCu (specimen 114), the specimens of the invention are exceedingly superior in mechanical properties, especially in 0.2% proof stress and tensile strength. This is attributable chiefly to the synergistic effect of controlling the amount of ferrite and addition of Co and N as alloy elements.

(B) Weldability

Specimens 1 to 16 of the present invention were tested for weldability by welding together four segments of each specimen in layers. The first and second layers were welded together by TIG arc welding after preparing the opposed edges at a groove angle of 20° and root face of 1.6 mm. The third and fourth layers were further welded end-to-end (butt welding) by shielded metal arc welding. The resulting assembly was found to have none of defects, such as cracks, by nondestructive inspection and by liquid penetrating inspection of cut sections of the weld zones. In this way, the specimens of the invention were found to have satisfactory weldability and to be free of any problem for use as piping materials.

(C) Corrosion resistance

(1) Test 1 (pitting test)

The specimens were checked for pitting resistance by Total Immersion Ferric Chloride Test according to ASTM Method G48 A with use of a solution of ferric chloride ($FeCl_3$). Table 3 shows the results. Specimens 1–16 according to the invention exhibited exceedingly higher pitting resistance than conventional materials, i.e. SUS 329Jl (specimen 111), SUS 316(specimen 112), SC 14A(specimen 113) and CD-4MCu (specimen 114), and exhibited substantially no weight loss by corrosion.

Comparison between the specimens of the invention and specimens 101 and 102 of very low N content reveals that N contributes remarkably to the improvement of pitting resistance, thus substantiating the significance of addition of N according to the invention.

Specimens 101 and 102, although low in N content, contain Co and are therefore superior to N- and Co-free specimen 114 in pitting resistance. This indicates that the presence of Co is effective for giving improved pitting resistance.

(2) Test 2 (crevice corrosion test)

The specimens were subjected to Ferric Chloride Crevice Test according to ASTM Method G48 B, using a solution of ferric chloride. The results are given in Table 3. Specimens 1-16 according to the invention exhibited much higher crevice corrosion resistance than conventional materials, i.e. SUS 329Jl (specimen 111), SUS 316 (specimen 112), SCS 14A (specimen 113) and CD-4MCu (specimen 114). Apparently the high resistance is attributable to Co and N serving as alloy components.

Comparison between the specimens of the invention and specimens 101 and 102 further shows that the addition of N is highly effective for giving improved crevice corrosion resistance, decreasing the corrosion loss to about 1/5 to 1/6 the amount that would otherwise result.

The results achieved by specimens 107 to 110 reveal that the amount of ferrite is another factor which influences the crevice corrosion resistance characteristics.

Specimens 101 and 102, although low in N content, contain Co and are superior to N- and Co-free specimen 114 in corrosion resistance. It can therefore be said that the presence of Co is effective for giving improved crevice corrosion resistance.

(3) Stress corrosion cracking resistance

Figure 2:
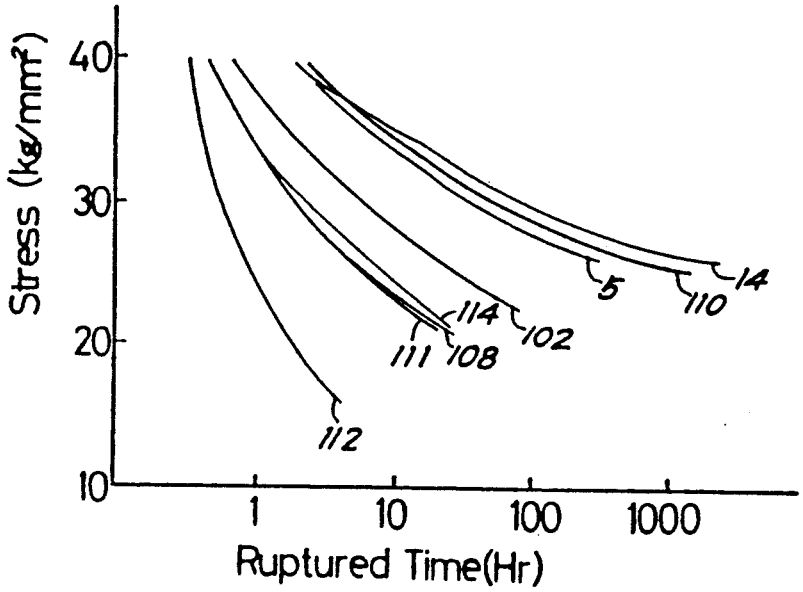

Some of the specimens were tested for resistance to stress corrosion cracking by the constant load method in boiling 42% solution of magnesium chloride ($MgCl_2$). FIGS. 1 and 2 show the results.

FIG. 1 shows that specimen 2 of the invention has much more excellent stress corrosion cracking resistance characteristics than SUS 329Jl (specimen 111), SUS 316 (specimen 112) and CD-4MCu (specimen 114) which are conventional materials. For example, when loaded with a stress of 30 kg/mm$^2$, SUS 329Jl (specimen 111) ruptures in about 2 hours, but the specimen 2 of the invention fractures in about 80 hours and therefore has greatly improved resistance.

The effect of addition of N to the steel of the invention becomes apparent from a comparison of specimen 2 with specimen 101. It is seen that whereas specimens 2 and 101 contain approximately the same amount of ferrite (about 50%), the addition of N gives improved resistance to stress corrosion cracking. Accordingly the steel of the invention is suited to use which involves presence of $Cl^-$ and in which this resistance is required.

As to the influence of the amount of ferrite, specimen 107 which is as small as 28% in this amount is not sufficient with respect to resistance to stress corrosion cracking, as seen in FIG. 1. On the other hand, specimen 109, which is as high as 74% in ferrite content, is superior to specimen 2 of the present invention in this resistance but is inferior in toughness and ductility after aging as already stated in the foregoing.

The result achieved by specimen 101 shows that the addition of Co produces a remarkable effect on stress corrosion cracking resistance. More specifically, specimen 101, although as low as 0.02% in N content, is higher than specimen 111 (SUS 329Jl) and specimen 114 (CD-4MCu) in this resistance.

Accordingly the outstanding resistance of specimens 2 and 12 to stress corrosion cracking is dependent on the synergistic effect afforded by the addition of Co and N as alloy elements and by the control of the amount of ferrite to a specified level.

It will be understood that the results shown in FIG. 2 are similar to those described above.

(4) Corrosion fatigue strength

Figure 3:
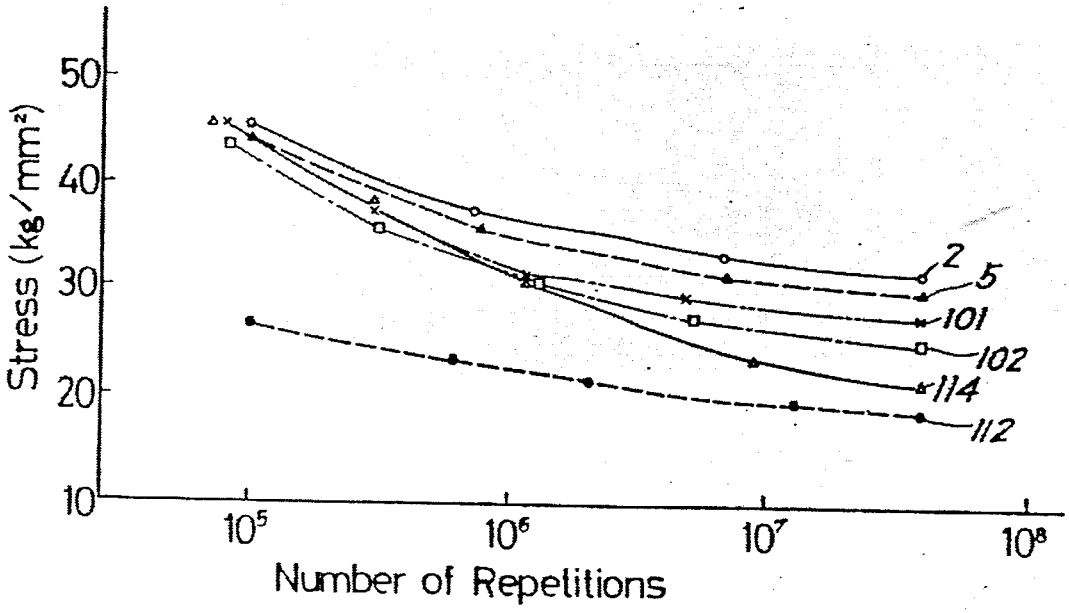
FIG. 3 is a graph showing corrosion fatigue strength as determined by rotational bending fatigue tests.

FIG. 3 shows the results obtained by conducting a rotational bending fatigue test according to the Ono method (with the tester rotated at 3000 r.p.m.), using artificial seawater prepared by the method prescribed by U.S. Navy.

Specimens 2 and 5 are superior to CD-4MCu (specimen 114) which is a conventional two-phase alloy and SUS 316 (specimen 112) which is austenitic stainless steel, in fatigue strength in seawater.

Comparison of specimens 101 and 102 with specimen 114 reveals the effect of Co. Specimens 101 and 102 have such low N contents as 0.02% and 0.03%, respectively, and basically differ in composition from specimen 114 only with respect to Co, so that the addition of Co to the duplex stainless steel is effective for giving corrosion fatigue strength in seawater.

Comparison of specimens 101 and 102 with specimens 2 and 5 reveals the effect of N, indicating that the addition of N is very effective for giving the duplex steel improved strength against corrosion fatigue in environments containing $Cl^-$. This is one of the greatest features of the steel of the invention.

The above results show that specimens 2 and 5 exhibit high corrosion fatigue strength in seawater owing to a synergistic effect of the addition of N and Co as alloy elements.

TABLE 1

| | Chemical Compositions (weight %) | | | | | | | | | Amount of |
|---|---|---|---|---|---|---|---|---|---|---|
| No. | C | Si | Mn | Cr | Ni | Mo | Cu | Co | N | Ferrite (%) |
| 1 | 0.020 | 0.66 | 0.56 | 25.32 | 7.15 | 3.03 | 1.12 | 1.21 | 0.07 | 55 |
| 2 | 0.018 | 0.82 | 0.83 | 25.52 | 7.08 | 2.98 | 1.06 | 1.04 | 0.19 | 53 |
| 3 | 0.017 | 0.84 | 0.72 | 26.89 | 5.87 | 2.76 | 1.09 | 0.98 | 0.28 | 57 |
| 4 | 0.020 | 0.76 | 0.81 | 21.08 | 6.53 | 3.12 | 1.01 | 1.12 | 0.07 | 51 |
| 5 | 0.023 | 0.67 | 0.64 | 21.50 | 5.21 | 3.08 | 1.05 | 0.97 | 0.18 | 47 |
| 6 | 0.020 | 0.71 | 0.59 | 22.09 | 4.35 | 3.30 | 0.84 | 0.97 | 0.29 | 48 |
| 7 | 0.023 | 0.94 | 0.64 | 24.40 | 8.81 | 3.02 | 1.01 | 1.11 | 0.17 | 32 |
| 8 | 0.021 | 0.62 | 0.63 | 29.78 | 4.21 | 2.99 | 0.98 | 1.13 | 0.21 | 68 |
| 9 | 0.022 | 0.72 | 0.67 | 19.53 | 7.52 | 3.01 | 1.10 | 0.96 | 0.19 | 33 |
| 10 | 0.021 | 0.77 | 0.67 | 23.68 | 3.81 | 2.98 | 1.03 | 0.98 | 0.21 | 69 |
| 11 | 0.018 | 0.65 | 0.61 | 25.00 | 8.01 | 3.01 | 0.99 | 0.47 | 0.17 | 51 |

TABLE 1-continued

| No. | Chemical Compositions (weight %) C | Si | Mn | Cr | Ni | Mo | Cu | Co | N | Amount of Ferrite (%) |
|---|---|---|---|---|---|---|---|---|---|---|
| 12 | 0.017 | 0.64 | 0.59 | 25.13 | 4.95 | 2.93 | 0.97 | 3.87 | 0.18 | 47 |
| 13 | 0.022 | 0.56 | 0.60 | 22.08 | 5.63 | 3.01 | 0.97 | 0.51 | 0.19 | 50 |
| 14 | 0.017 | 0.63 | 0.69 | 22.10 | 3.28 | 2.97 | 1.03 | 3.85 | 0.20 | 47 |
| 15 | 0.017 | 0.65 | 0.99 | 25.98 | 4.93 | 3.11 | 1.08 | 1.08 | 0.34 | 49 |
| 16 | 0.021 | 0.74 | 0.61 | 23.52 | 3.33 | 3.22 | 0.83 | 1.00 | 0.34 | 46 |
| 101 | 0.023 | 0.98 | 0.67 | 25.29 | 7.89 | 2.98 | 0.99 | 1.02 | 0.02 | 51 |
| 102 | 0.020 | 0.89 | 0.76 | 21.05 | 7.41 | 2.89 | 1.10 | 1.21 | 0.03 | 49 |
| 103 | 0.021 | 0.58 | 0.59 | 24.89 | 4.41 | 3.02 | 0.98 | 1.01 | 0.38 | 51 |
| 104 | 0.019 | 0.63 | 0.58 | 23.61 | 3.11 | 3.03 | 1.10 | 0.99 | 0.39 | 56 |
| 105 | 0.018 | 0.60 | 0.63 | 25.11 | 8.21 | 3.05 | 1.02 | 0.12 | 0.18 | 57 |
| 106 | 0.017 | 0.69 | 0.72 | 22.28 | 5.83 | 2.98 | 1.07 | 0.16 | 0.19 | 56 |
| 107 | 0.024 | 0.75 | 0.64 | 23.95 | 8.79 | 2.87 | 0.89 | 1.02 | 0.18 | 28 |
| 108 | 0.025 | 0.76 | 0.54 | 20.54 | 8.03 | 3.00 | 0.96 | 1.12 | 0.17 | 27 |
| 109 | 0.019 | 0.69 | 0.68 | 29.89 | 3.99 | 3.00 | 0.96 | 1.11 | 0.22 | 74 |
| 110 | 0.024 | 0.60 | 0.59 | 24.02 | 3.76 | 2.91 | 0.99 | 1.13 | 0.18 | 73 |
| 111 | 0.017 | 0.52 | 0.42 | 24.89 | 4.17 | 1.83 | — | — | — | 61 |
| 112 | 0.070 | 0.80 | 1.91 | 16.54 | 11.71 | 2.07 | — | — | — | 0 |
| 113 | 0.060 | 1.41 | 1.13 | 20.37 | 10.19 | 2.49 | — | — | — | 14 |
| 114 | 0.021 | 0.53 | 0.56 | 25.73 | 5.21 | 2.08 | 2.95 | — | — | 57 |

TABLE 2

| No. | 0.2% Proof Stress (Kg/mm$^2$) | Tensile Strength (Kg/mm$^2$) | Elongation (%) | Hardness (HB) | Absorbed Energy (Kg · m, 0° C.) |
|---|---|---|---|---|---|
| 1 | 56.0 | 77.6 | 40.5 | 202 | 20.1 |
| 2 | 59.7 | 80.9 | 39.3 | 202 | 19.7 |
| 3 | 62.3 | 83.4 | 38.1 | 205 | 18.2 |
| 4 | 55.4 | 76.3 | 38.3 | 203 | 20.4 |
| 5 | 58.5 | 79.8 | 36.4 | 205 | 18.7 |
| 6 | 60.7 | 81.7 | 35.7 | 210 | 18.1 |
| 7 | 55.6 | 75.3 | 40.8 | 203 | 20.0 |
| 8 | 65.1 | 83.9 | 29.3 | 209 | 14.1 |
| 9 | 56.7 | 75.9 | 38.3 | 200 | 20.7 |
| 10 | 61.9 | 81.8 | 30.1 | 208 | 15.8 |
| 11 | 58.8 | 80.0 | 38.9 | 206 | 20.5 |
| 12 | 65.4 | 85.2 | 37.1 | 211 | 18.6 |
| 13 | 56.3 | 78.3 | 38.1 | 204 | 20.0 |
| 14 | 63.4 | 83.5 | 36.1 | 209 | 18.0 |
| 15 | 64.8 | 85.7 | 35.7 | 209 | 18.0 |
| 16 | 62.8 | 83.8 | 33.1 | 209 | 18.9 |
| 101 | 53.1 | 72.6 | 41.8 | 201 | 20.2 |
| 102 | 52.0 | 71.7 | 40.5 | 200 | 19.8 |
| 103 | 65.1 | 85.9 | 34.1 | 211 | 17.1 |
| 104 | 63.7 | 84.7 | 31.6 | 210 | 17.9 |
| 105 | 56.9 | 78.8 | 39.0 | 205 | 20.6 |
| 106 | 54.4 | 76.4 | 37.8 | 202 | 20.3 |
| 107 | 54.3 | 73.9 | 43.1 | 200 | 20.9 |
| 108 | 52.3 | 73.1 | 43.4 | 201 | 20.3 |
| 109 | 65.3 | 82.3 | 24.1 | 208 | 11.8 |
| 110 | 62.3 | 81.8 | 25.6 | 207 | 12.7 |
| 111 | 60.2 | 79.5 | 30.0 | 201 | 18.6 |
| 112 | 24.6 | 55.5 | 70.3 | 185 | 25.4 |
| 113 | 28.1 | 57.6 | 59.4 | 194 | 20.5 |
| 114 | 52.1 | 73.7 | 20.5 | 234 | 7.1 |

TABLE 3

| No. | Weight loss by corrosion (g/m$^2$ hr) Test 1 (ASTM G 48A) | Test 2 (ASTM G 48B) |
|---|---|---|
| 1 | 0.5 | 1.52 |
| 2 | 0 | 0.73 |
| 3 | 0 | 0.64 |
| 4 | 0.7 | 1.74 |
| 5 | 0 | 1.01 |
| 6 | 0 | 0.90 |
| 7 | 0 | 0.79 |
| 8 | 0 | 0.80 |
| 9 | 0 | 1.05 |
| 10 | 0 | 1.11 |
| 11 | 0 | 0.74 |
| 12 | 0 | 0.61 |
| 13 | 0 | 1.00 |
| 14 | 0 | 0.89 |
| 15 | 0 | 0.65 |

TABLE 3-continued

| No. | Weight loss by corrosion (g/m$^2$ hr) Test 1 (ASTM G 48A) | Test 2 (ASTM G 48B) |
|---|---|---|
| 16 | 0 | 0.89 |
| 101 | 2.9 | 4.58 |
| 102 | 4.1 | 5.73 |
| 103 | 0.8 | 1.92 |
| 104 | 0.9 | 2.01 |
| 105 | 0.3 | 1.11 |
| 106 | 0.5 | 1.49 |
| 107 | 0.2 | 1.62 |
| 108 | 0.3 | 1.83 |
| 109 | 0.2 | 1.58 |
| 110 | 0.2 | 1.79 |
| 111 | 20.9 | 20.00 |
| 112 | 21.4 | 19.80 |
| 113 | 25.7 | 20.40 |
| 114 | 14.3 | 15.11 |

To sum up, the foregoing results reveal the following features of the ferritic-austenitic duplex stainless steel of the invention.

The duplex stainless steel according to the present invention has high strength specifically in respect of 0.2% proof stress with about at least 55 kg/mm$^2$.

The steel is outstanding in corrosion characteristics (resistance to usual corrosion and resistance to stress corrosion cracking, to pitting and to crevice corrosion), has high proof stress while retaining ductility and toughness of not lower than a specified level and is therefore suitable for tubing or couplings for oil wells, and gathering pipes, line pipes or the like for use in highly corrosive environments.

Further because the duplex stainless steel of the invention is excellent also in weldability, the steel is best suited as a piping material for oil wells. The present steel exhibits higher durability and stability than conventional materials when used for applications which require high corrosion resistance and good mechanical properties.

Furthermore, because the duplex stainless steel according to the present invention is large with respect to absorbed energy of impact at 0° C., i.e., excellent in toughness at the lowered temperature, the steel is also well suited as a piping material for oil wells, which is particularly used at cold districts, for instance, at Alaska, the North Sea or the like.

What is claimed is:

1. A ferritic-austenitic duplex stainless steel consisting of the following components and the following proportions in terms of % by weight, $0<C\leqq 0.08$ Si 0.2–2.0
Mn 0.2–2.0
Cr 19.0–30.0
Ni 3.0–9.0
Mo 1.0–2.76
Cu 0.5–3.0
Co 0.2–4.0
N 0.05–0.35 the balance being Fe and inevitable impurities, the proportions of Cr and Ni having a correlation of $19.0\leqq Cr\leqq 24.0$ and $3.0\leqq Ni\leqq 8.0$, or $24.0\leqq Cr\leqq 30.0$ and $4.0\leqq Ni\leqq 9.0$, the microstructure of the steel containing delta-ferrite phase in an amount of 30 to 70% in area ratio.

2. A centrifugally casted steel pipe or couplings for use in corrosive environment, said pipe or couplings formed of a ferritic-austenitic duplex stainless steel consisting of the following components and the following proportions in terms of % by weight, $0\leqq C\leqq 0.08$ Si 0.2–2.0
Mn 0.2–2.0
Cr 19.0–30.0
Ni 3.0–9.0
Mo 1.0–2.76
Cu 0.5–3.0
Co 0.2–4.0
N 0.05–0.35 the balance being Fe and inevitable impurities, the proportions of Cr and Ni having a correlation of $19.0\leqq Cr\leqq 24.0$ and $3.0\leqq Ni\leqq 8.0$, or $24.0\leqq Cr\leqq 30.0$ and $4.0\leqq Ni\leqq 9.0$, the micro-structure of the steel containing delta-ferrite phase in an amount of 30 to 70% in area ratio.

* * * * *